US011581647B2

(12) United States Patent
Lee et al.

(10) Patent No.: US 11,581,647 B2
(45) Date of Patent: Feb. 14, 2023

(54) ANTENNA STRUCTURE

(71) Applicant: Wistron NeWeb Corp., Hsinchu (TW)

(72) Inventors: Yun-Tsan Lee, Hsinchu (TW); Chia-Hao Chang, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 311 days.

(21) Appl. No.: 17/022,391

(22) Filed: Sep. 16, 2020

(65) Prior Publication Data

US 2021/0336339 A1 Oct. 28, 2021

(30) Foreign Application Priority Data

Apr. 24, 2020 (TW) ..... 109113707

(51) Int. Cl.

| | |
|---|---|
| ***H01Q 5/371*** | (2015.01) |
| ***H01Q 1/48*** | (2006.01) |
| ***H01Q 1/24*** | (2006.01) |
| ***H01Q 5/364*** | (2015.01) |
| ***H01Q 13/10*** | (2006.01) |

(52) U.S. Cl.

CPC ..... *H01Q 5/371* (2015.01); *H01Q 1/48* (2013.01); *H01Q 1/243* (2013.01); *H01Q 5/364* (2015.01); *H01Q 13/10* (2013.01)

(58) Field of Classification Search

CPC ..... H01Q 5/371; H01Q 13/106; H01Q 13/16–18; H01Q 13/10; H01Q 5/357; H01Q 5/364; H01Q 5/385

See application file for complete search history.

(56) References Cited

U.S. PATENT DOCUMENTS

| | | | | |
|---|---|---|---|---|
| 6,343,208 | B1 * | 1/2002 | Ying | H01Q 1/36 343/702 |
| 2013/0063321 | A1 * | 3/2013 | Ruvinsky | H01Q 5/371 343/771 |
| 2014/0118204 | A1 | 5/2014 | Gavilan et al. | |
| 2020/0411987 | A1 * | 12/2020 | Lo | H01Q 5/385 |

* cited by examiner

*Primary Examiner* — Ricardo I Magallanes

(74) *Attorney, Agent, or Firm* — McClure, Qualey & Rodack, LLP

(57) ABSTRACT

An antenna structure includes a ground metal element, a first metal element, and a second metal element. The ground metal element has a slot. A feeding point is positioned at the first metal element. The first metal element and the second metal element are coupled to the ground metal element. The first metal element and the second metal element extend into the interior of the slot. The slot includes a first branch portion, a second branch portion, a third branch portion, and a fourth branch portion. The first metal element is disposed between the second branch portion and the third branch portion of the slot. The second metal element is disposed between the third branch portion and the fourth branch portion of the slot.

20 Claims, 6 Drawing Sheets

ANTENNA STRUCTURE

CROSS REFERENCE TO RELATED APPLICATIONS

This Application claims priority of Taiwan Patent Application No. 109113707 filed on Apr. 24, 2020, the entirety of which is incorporated by reference herein.

BACKGROUND OF THE INVENTION

Field of the Invention

The disclosure generally relates to an antenna structure, and more particularly, to a wideband antenna structure.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz, and 5.8 GHz.

Antennas are indispensable elements for wireless communication. If an antenna for signal reception and transmission has insufficient bandwidth, it will degrade the communication quality of the relative mobile device. Accordingly, it has become a critical challenge for antenna designers to design a small-size, wideband antenna element.

BRIEF SUMMARY OF THE INVENTION

In an exemplary embodiment, the invention is directed to an antenna structure that includes a ground metal element, a first metal element, and a second metal element. The ground metal element has a slot. A feeding point is positioned at the first metal element. The first metal element and the second metal element are coupled to the ground metal element. The first metal element and the second metal element extend into the interior of the slot. The slot includes a first branch portion, a second branch portion, a third branch portion, and a fourth branch portion. The first metal element is disposed between the second branch portion and the third branch portion of the slot. The second metal element is disposed between the third branch portion and the fourth branch portion of the slot.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

Figure 1:
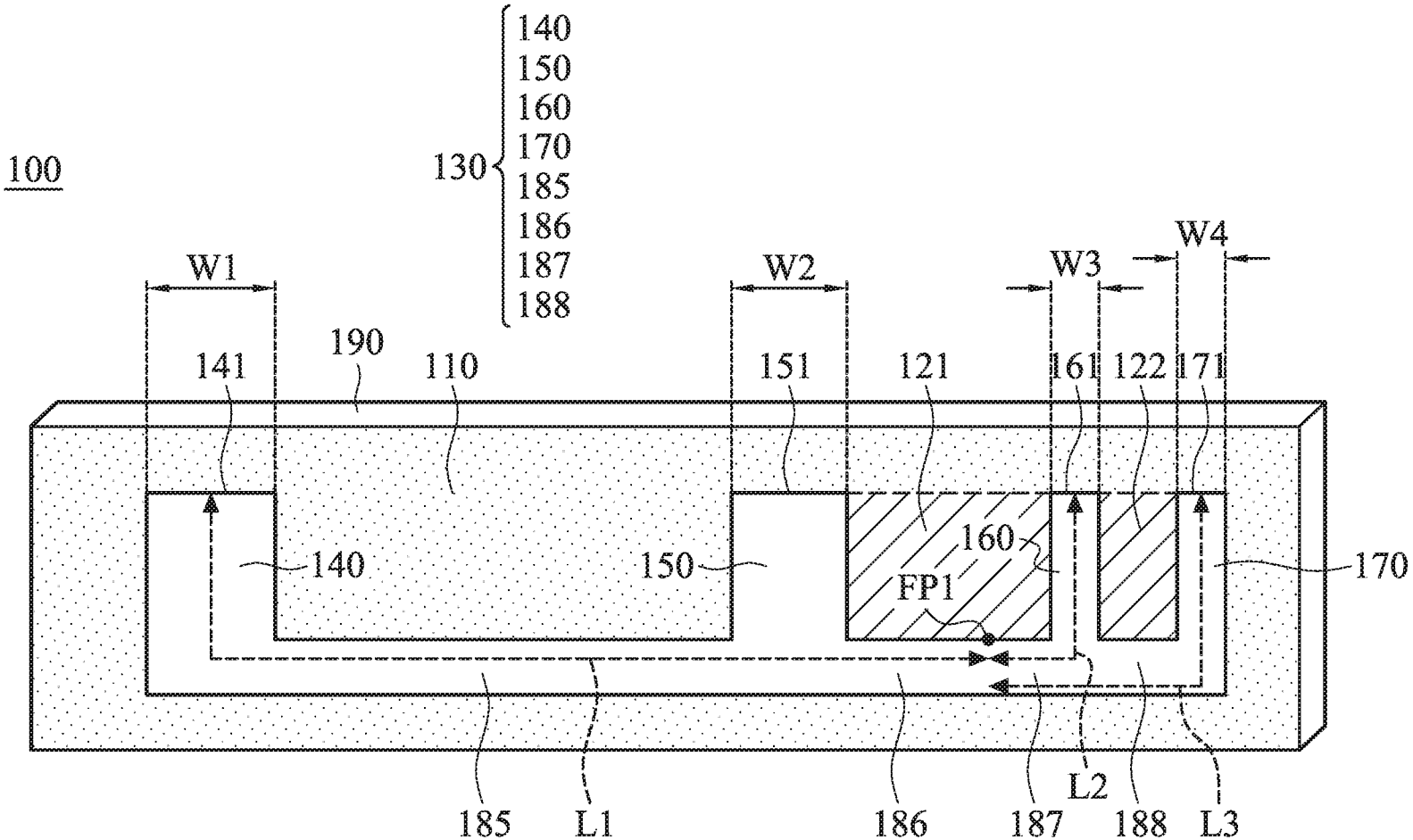
FIG. 1 is a diagram of an antenna structure according to an embodiment of the invention.

In order to illustrate the foregoing and other purposes, features and advantages of the invention, the embodiments and figures of the invention will be described in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

FIG. 1 is a diagram of an antenna structure 100 according to an embodiment of the invention. The antenna structure 100 may be applied to a mobile device, such as a smartphone, a tablet computer, or a notebook computer. As shown in FIG. 1, the antenna structure 100 includes a ground metal element 110, a first metal element 121, and a second metal element 122.

The ground metal element 110 has a slot 130, which is a non-metal region. A feeding point FP1 is positioned at the first metal element 121. The feeding point FP1 may be coupled to a positive electrode of a signal source, and a negative electrode of the signal source may be coupled to the ground metal element 110. For example, the aforementioned signal source (not shown) may be an RF (Radio Frequency) module for exciting the antenna structure 100. The first metal element 121 and the second metal element 122 are both coupled to the ground metal element 110. Both the first metal element 121 and the second metal element 122 can extend into the interior of the slot 130, such that the whole slot 130 may have an irregular shape.

The slot 130 includes a first branch portion 140, a second branch portion 150, a third branch portion 160, and a fourth branch portion 170. The first metal element 121 is disposed between the second branch portion 150 and the third branch portion 160. The second metal element 122 is disposed between the third branch portion 160 and the fourth branch portion 170. For example, each of the first branch portion 140, the second branch portion 150, the third branch portion 160, and the fourth branch portion 170 of the slot 130 may substantially have a straight-line shape, but it is not limited thereto. In some embodiments, the first branch portion 140, the second branch portion 150, the third branch portion 160, and the fourth branch portion 170 of the slot 130 are substantially parallel to each other. The first branch portion 140 and the second branch portion 150 of the slot 130 are positioned at the same side (e.g., the left side) of the feeding point FP1. The third branch portion 160 and the fourth branch portion 170 of the slot 130 are both positioned at the opposite side (e.g., the right side) of the feeding point FP1. Specifically, the first branch portion 140 of the slot 130 has a first closed end 141, the second branch portion 150 of the slot 130 has a second closed end 151, the third branch portion 160 of the slot 130 has a third closed end 161, and the fourth branch portion 170 of the slot 130 has a fourth closed end 171. In some embodiments, the first closed end 141, the second closed end 151, the third closed end 161, and the fourth closed end 171 are substantially arranged in the same straight line.

In some embodiments, the slot 130 further includes a first connection portion 185, a second connection portion 186, a third connection portion 187, and a fourth connection portion 188. The first connection portion 185 is connected between the first branch portion 140 and the second branch portion 150. The second connection portion 186 and the third connection portion 187 are both connected between the second branch portion 150 and the third branch portion 160. The fourth connection portion 188 is connected between the third branch portion 160 and the fourth branch portion 170. For example, the combination of the first connection portion 185, the second connection portion 186, the third connection portion 187, and the fourth connection portion 188 of the slot 130 may substantially have a straight-line shape, but it is not limited thereto. Specifically, the feeding point FP1 may be positioned between the second connection portion 186 and the third connection portion 187 of the slot 130.

In some embodiments, the antenna structure 100 further includes a nonconductive support element 190. The ground metal element 110, the first metal element 121, and the second metal element 122 may form a planar structure, which is disposed on the nonconductive support element 190. The nonconductive support element 190 may be a plastic element, a PCB (Printed Circuit Board), or an FCB (Flexible Circuit Board). For example, if the nonconductive support element 190 is a plastic housing, the ground metal element 110, the first metal element 121, and the second metal element 122 may adhere to the nonconductive support element 190 by using LDS (Laser Direct Structuring) technology.

Figure 2:
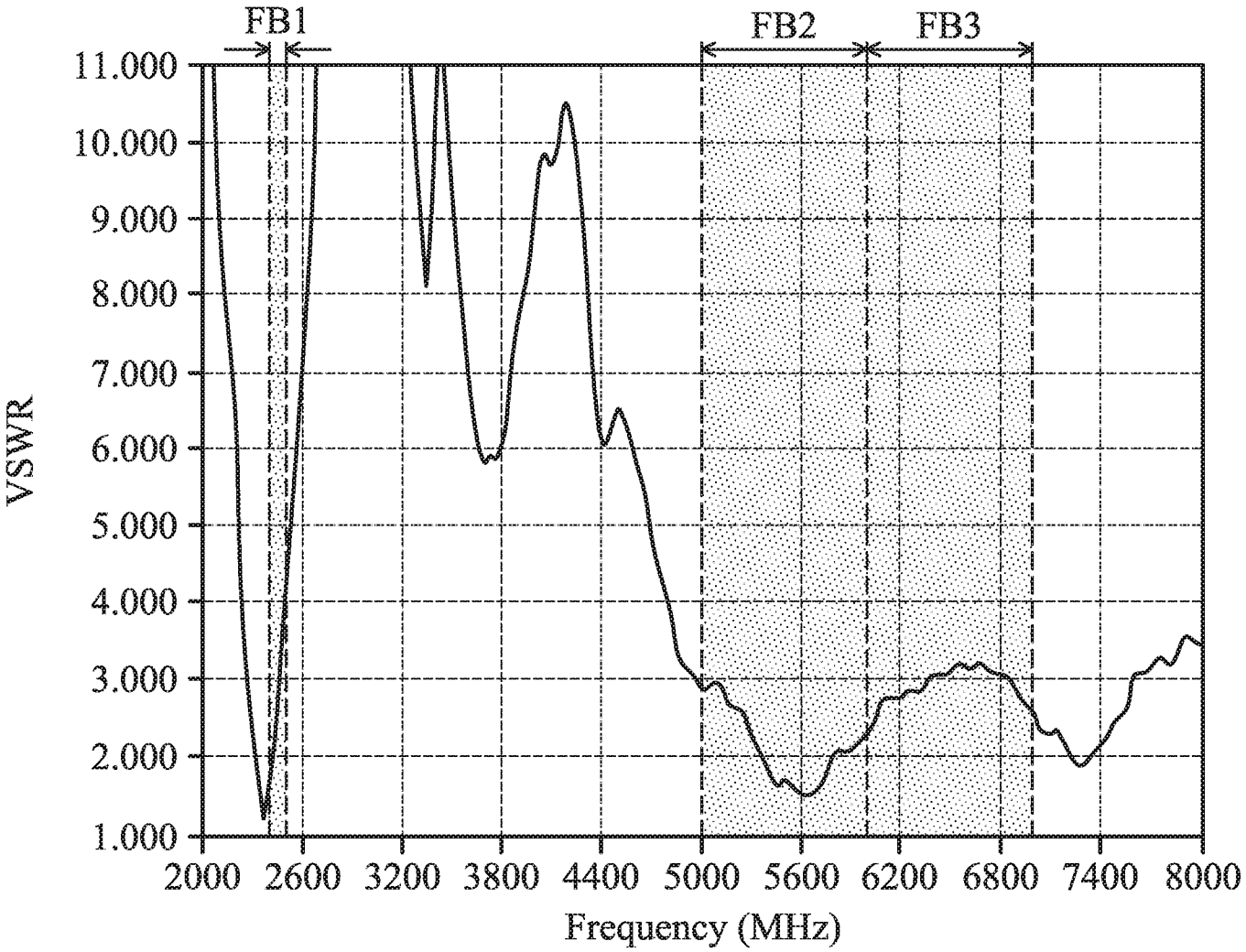
FIG. 2 is a diagram of VSWR (Voltage Standing Wave Ratio) of an antenna structure according to an embodiment of the invention.

FIG. 2 is a diagram of VSWR (Voltage Standing Wave Ratio) of the antenna structure 100 according to an embodiment of the invention. The horizontal axis represents operation frequency (MHz), and the vertical axis represents the VSWR. According to the measurement of FIG. 2, the antenna structure 100 can covers a first frequency band FB1, a second frequency band FB2, and a third frequency band FB3. The first frequency band FB1 may be from 2400 MHz to 2500 MHz. The second frequency band FB2 may be from 5000 MHz to 6000 MHz. The third frequency band FB3 may be from 6000 MHz to 7125 MHz. In some embodiments, the radiation gain of the antenna structure 100 is about −2.61 dB in the first frequency band FB1, the radiation gain of the antenna structure 100 is about −4 dB in the second frequency band FB2, and the radiation gain of the antenna structure 100 is about −3.71 dB in the third frequency band FB3. Therefore, the antenna structure 100 can support at least the wideband operations of Wi-Fi 5 (IEEE 802.11ac) and Wi-Fi 6 (IEEE 802.11ax).

In some embodiments, the operation principles of the antenna structure 100 are described as follows. The first branch portion 140, the first connection portion 185, and the second connection portion 186 of the slot 130 are excited to generate the first frequency band FB1. The third branch portion 160 and the third connection portion 187 of the slot 130 are excited to generate the second frequency band FB2. The fourth branch portion 170, the fourth connection portion 188, and the third connection portion 187 of the slot 130 are excited to generate the third frequency band FB3. The first metal element 121 can provide an inductance for fine-tuning the impedance matching of the first frequency band FB1. The second metal element 122 can also provide an inductance for fine-tuning the impedance matching of the second frequency band FB2 and the third frequency band FB3. Furthermore, the second branch portion 150 of the slot 130 can fine-tune the impedance matching of the first frequency band FB1, the second frequency band FB2, and the third frequency band FB3.

In some embodiments, the element sizes of the antenna structure 100 are described as follows. The total length L1 of the first branch portion 140, the first connection portion 185, and the second connection portion 186 of the slot 130 (i.e., the total length L1 from the feeding point FP1 through the second connection portion 186 and the first connection portion 185 to the first closed end 141 of the first branch portion 140) may be from 0.5 to 1 wavelength (0.5λ~1λ) of the central frequency of the first frequency band FB1 of the antenna structure 100. The total length L2 of the third branch portion 160 and the third connection portion 187 of the slot 130 (i.e., the total length L2 from the feeding point FP1 through the third connection portion 187 to the third closed end 161 of the third branch portion 160) may be from 0.5 to 1 wavelength (0.5λ~1λ) of the central frequency of the second frequency band FB2 of the antenna structure 100. The total length L3 of the fourth branch portion 170, the fourth connection portion 188, and the third connection portion 187 of the slot 130 (i.e., the total length L3 from the feeding point FP1 through the third connection portion 187 and the fourth connection portion 188 to the fourth closed end 171 of the fourth branch portion 170) may be from 0.5 to 1 wavelength (0.5λ~1λ) of the central frequency of the third frequency band FB3 of the antenna structure 100. The first branch portion 140 and the second branch portion 150 (or the first closed end 141 and the second closed end 151) of the slot 130 may have relatively large widths W1 and W2. The third branch portion 160 and the fourth branch portion 170 (or the third closed end 161 and the fourth closed end 171) of the slot 130 may have relatively small widths W3 and W4. The aforementioned widths W1, W2, W3 and W4 may all be greater than or equal to 0.3 mm. For example, the width W1 of the first branch portion 140 may be 3 or more times the width W4 of the fourth branch portion 170, and the width W2 of the second branch portion 150 may be 2 or more times the width W3 of the third branch portion 160. The thickness of the nonconductive support element 190 may be greater than or equal to 0.2 mm. The antenna structure 100 may have a total length of about 8 mm and a total width of about 25 mm. The above ranges of element sizes are calculated and obtained according to many experiment results, and they help to optimize the operation bandwidth and impedance matching of the antenna structure 100.

Adjustment of embodiments of the antenna structure 100 will be introduced as follows. It should be understood that these figures and descriptions are merely exemplary, rather than limitations of the invention.

Figure 3:
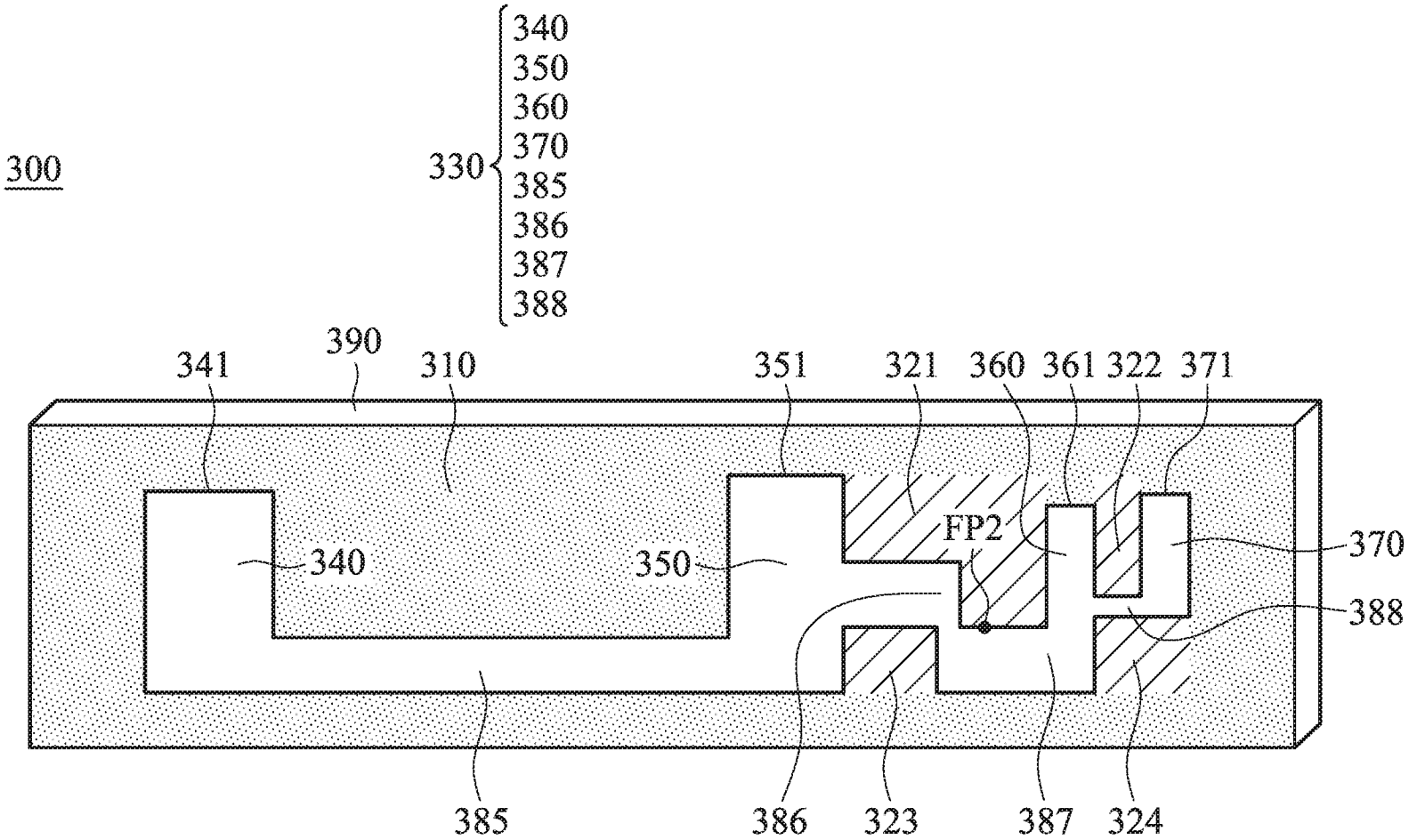
FIG. 3 is a diagram of an antenna structure according to an embodiment of the invention.

FIG. 3 is a diagram of an antenna structure 300 according to an embodiment of the invention. FIG. 3 is similar to FIG. 1. In the embodiment of FIG. 3, the antenna structure 300 includes a ground metal element 310, a first metal element 321, and a second metal element 322, a third metal element 323, a fourth metal element 324, and a nonconductive support element 390. A feeding point FP2 is positioned at the first metal element 321. Specifically, the ground metal element 310 has a slot 330. The slot 330 includes a first branch portion 340 with a first closed end 341, a second branch portion 350 with a second closed end 351, a third branch portion 360 with a third closed end 361, a fourth branch portion 370 with a fourth closed end 371, a first connection portion 385, a second connection portion 386, a third connection portion 387, and a fourth connection portion 388.

The main difference from the antenna structure 100 of the embodiment of FIG. 1 is that the first metal element 321 substantially has an L-shape, the second metal element 322 substantially has a straight-line shape, the third metal element 323 substantially has a relatively small square shape, and the fourth metal element 324 substantially has a relatively large square shape. In addition, each of the second connection portion 386 and the third connection portion 387 of the slot 330 may substantially have a variable-width L-shape. The third metal element 323 and the fourth metal element 324 are both coupled to the ground metal element 310. Both the third metal element 323 and the fourth metal element 324 extend into the interior of the slot 330. The third metal element 323 is disposed opposite to the first metal element 321. The third metal element 323 is separated from the first metal element 321 by the second connection portion 386 of the slot 330. The fourth metal element 324 is disposed opposite to the second metal element 322. The fourth metal element 324 is separated from the second metal element 322 by the fourth connection portion 388 of the slot 330.

Figure 4:
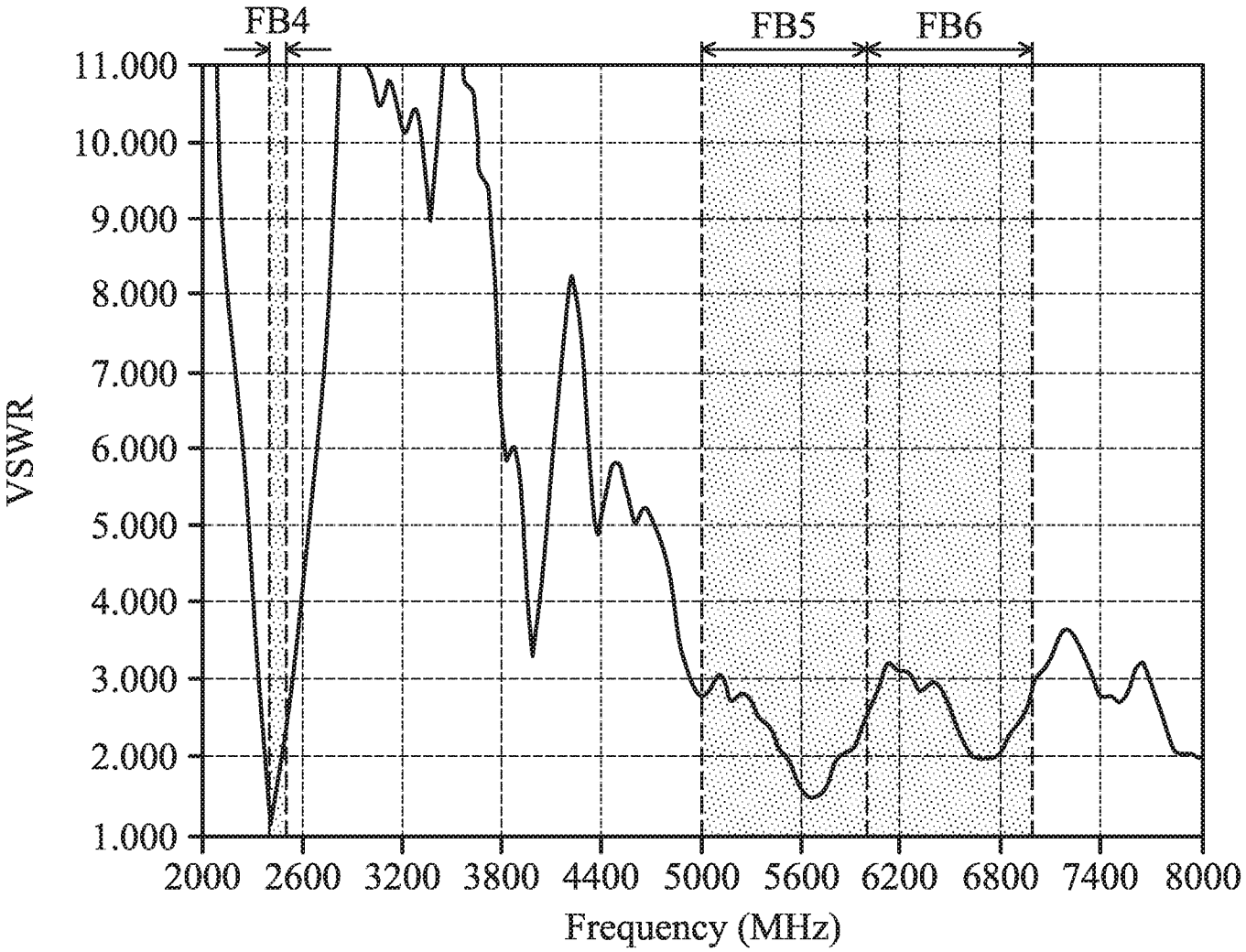
FIG. 4 is a diagram of VSWR of an antenna structure according to an embodiment of the invention.

FIG. 4 is a diagram of VSWR of the antenna structure 300 according to an embodiment of the invention. The horizontal axis represents operation frequency (MHz), and the vertical axis represents the VSWR. According to the measurement of FIG. 4, the antenna structure 300 can covers a first frequency band FB4, a second frequency band FB5, and a third frequency band FB6. The first frequency band FB4 may be from 2400 MHz to 2500 MHz. The second frequency band FB5 may be from 5000 MHz to 6000 MHz. The third frequency band FB6 may be from 6000 MHz to 7125 MHz. In some embodiments, the radiation gain of the antenna structure 300 is about −3.02 dB in the first frequency band FB4, the radiation gain of the antenna structure 300 is about −3.22 dB in the second frequency band FB5, and the radiation gain of the antenna structure 300 is about −3.43 dB in the third frequency band FB6. Generally, the third metal element 323 and the fourth metal element 324 can provide additional inductances, and fine-tune the impedance matching of the first frequency band FB4, the second frequency band FB5, and the third frequency band FB6. Other features of the antenna structure 300 of FIG. 3 are similar to those of the antenna structure 100 of FIG. 1. Accordingly, the two embodiments can achieve similar levels of performance.

Figure 5:
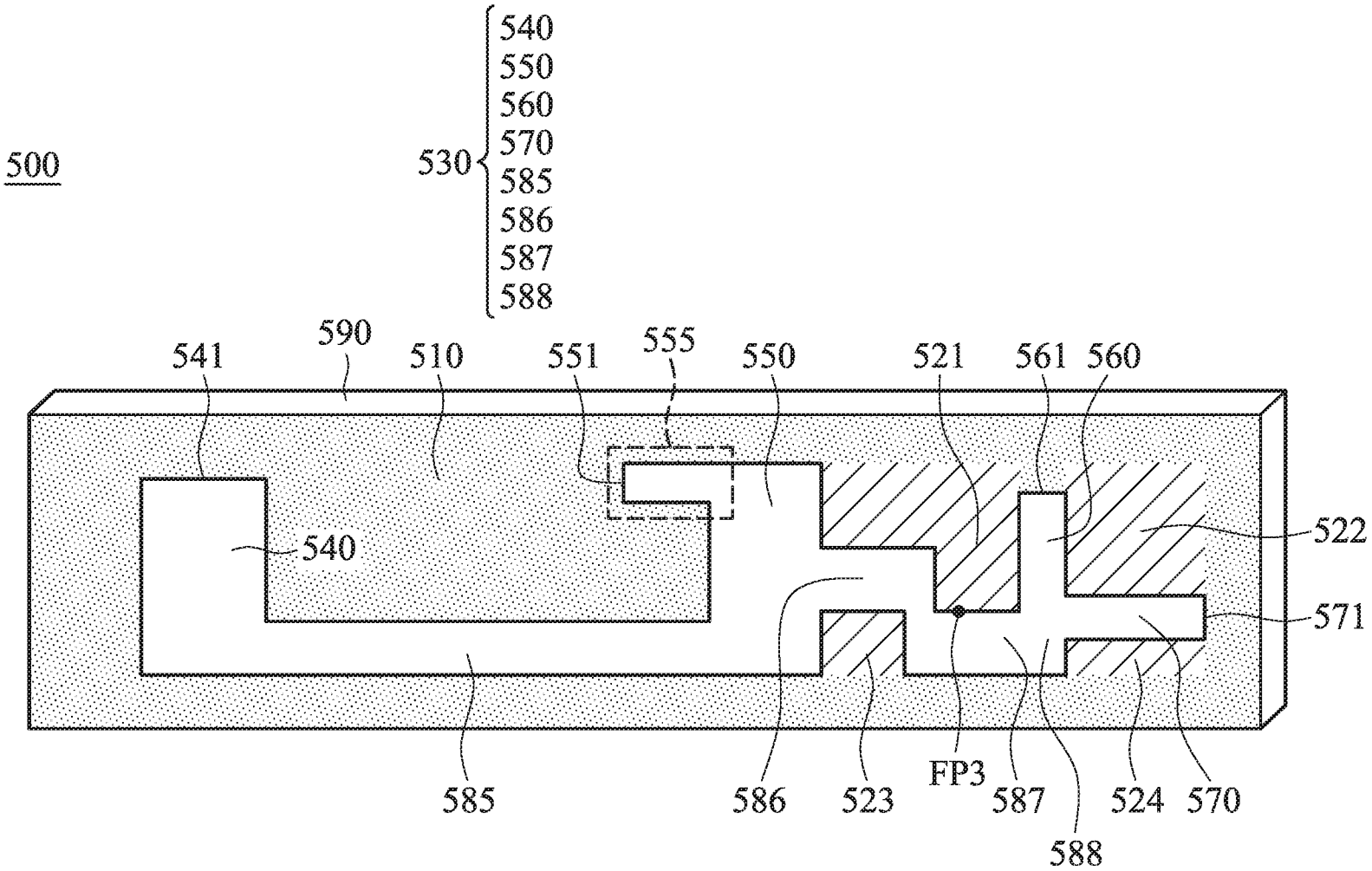
FIG. 5 is a diagram of an antenna structure according to an embodiment of the invention.

FIG. 5 is a diagram of an antenna structure 500 according to an embodiment of the invention. FIG. 5 is similar to FIG. 1. In the embodiment of FIG. 5, the antenna structure 500 includes a ground metal element 510, a first metal element 521, and a second metal element 522, a third metal element 523, a fourth metal element 524, and a nonconductive support element 590. A feeding point FP3 is positioned at the first metal element 521. Specifically, the ground metal element 510 has a slot 530. The slot 530 includes a first branch portion 540 with a first closed end 541, a second branch portion 550 with a second closed end 551, a third branch portion 560 with a third closed end 561, a fourth branch portion 570 with a fourth closed end 571, a first connection portion 585, a second connection portion 586, a third connection portion 587, and a fourth connection portion 588.

The main difference from the antenna structure 100 of the embodiment of FIG. 1 is that the first metal element 521 substantially has an L-shape, the second metal element 522 substantially has a relatively large square shape, the third metal element 523 substantially has a relatively small square shape, and the fourth metal element 524 substantially has a thin, long and rectangular shape. In addition, the second branch portion 550 of the slot 530 may further include a right-angle bending terminal region 555 (adjacent to the second closed end 551). The third branch portion 560 and the fourth branch portion 570 of the slot 530 may be substantially perpendicular to each other. The third metal element 523 and the fourth metal element 524 are both coupled to the ground metal element 510. Both the third metal element 523 and the fourth metal element 524 extend into the interior of the slot 530. The third metal element 523 is disposed opposite to the first metal element 521. The third metal element 523 is separated from the first metal element 521 by the second connection portion 586 of the slot 530. The fourth metal element 524 is disposed opposite to the second metal element 522. The fourth metal element 524 is separated from the second metal element 522 by the fourth branch portion 570 of the slot 530.

Figure 6:
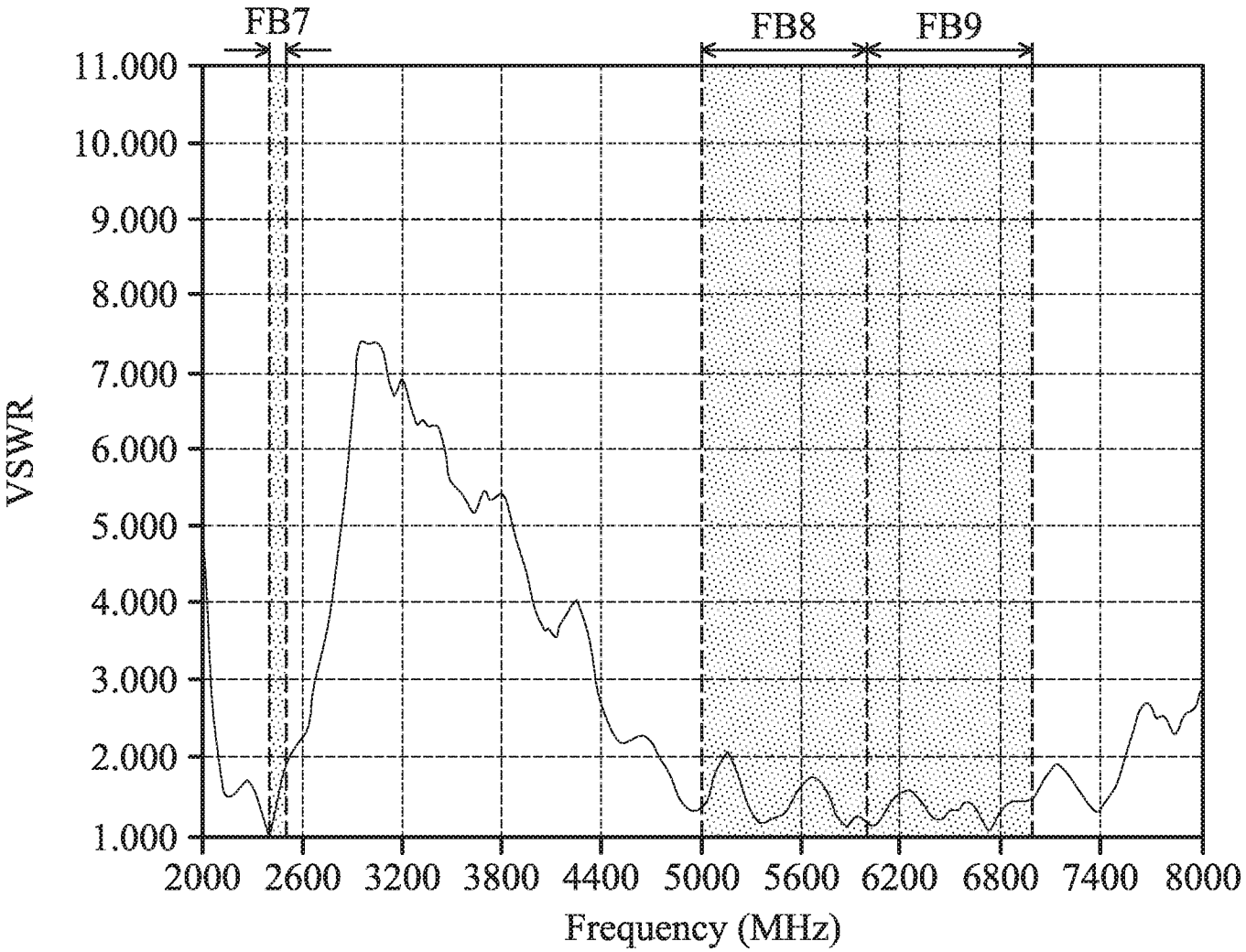
FIG. 6 is a diagram of VSWR of an antenna structure according to an embodiment of the invention.

FIG. 6 is a diagram of VSWR of the antenna structure 500 according to an embodiment of the invention. The horizontal axis represents operation frequency (MHz), and the vertical axis represents the VSWR. According to the measurement of FIG. 6, the antenna structure 500 can covers a first frequency band FB7, a second frequency band FB8, and a third frequency band FB9. The first frequency band FB7 may be from 2400 MHz to 2500 MHz. The second frequency band FB8 may be from 5000 MHz to 6000 MHz. The third frequency band FB9 may be from 6000 MHz to 7125 MHz. In some embodiments, the radiation gain of the antenna structure 500 is about −2.51 dB in the first frequency band FB7, the radiation gain of the antenna structure 500 is about −3.57 dB in the second frequency band FB8, and the radiation gain of the antenna structure 500 is about −3.62 dB in the third frequency band FB9. Generally, the right-angle bending terminal region 555 of the second branch portion 550 of the slot 530 can fine-tune the impedance matching of the second frequency band FB8 and the third frequency band FB9. The third branch portion 560 and the fourth branch portion 570, which are substantially orthogonal to each other, can increase the operation bandwidths of the second frequency band FB8 and the third frequency band FB9.

Other features of the antenna structure 500 of FIG. 5 are similar to those of the antenna structure 100 of FIG. 1. Accordingly, the two embodiments can achieve similar levels of performance.

The invention proposes a novel antenna structure. In comparison to the conventional design, the invention has at least the advantages of small size, wide bandwidth, and single-layer planarization design, and therefore it is suitable for application in a variety of mobile communication devices.

Note that the above element sizes, element shapes, and frequency ranges are not limitations of the invention. An antenna designer can fine-tune these settings or values according to different requirements. It should be understood that the antenna structure of the invention is not limited to the configurations of FIGS. 1-6. The invention may include any one or more features of any one or more embodiments of FIGS. 1-6. In other words, not all of the features displayed in the figures should be implemented in the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

It will be apparent to those skilled in the art that various modifications and variations can be made in the invention. It is intended that the standard and examples be considered as exemplary only, with the true scope of the disclosed embodiments being indicated by the following claims and their equivalents.

What is claimed is:

1. An antenna structure, comprising:

a ground metal element, having a slot;

a first metal element, wherein a feeding point is positioned at the first metal element;

a second metal element, wherein the first metal element and the second metal element are coupled to the ground metal element, and wherein the first metal element and the second metal element extend into an interior of the slot;

wherein the slot comprises a first branch portion, a second branch portion, a third branch portion, and a fourth branch portion;

wherein the first metal element is disposed between the second branch portion and the third branch portion, and wherein the second metal element is disposed between the third branch portion and the fourth branch portion;

wherein the first metal element and the second metal element are substantially parallel to each other;

wherein a width of the second branch portion is 2 or more times that of the third branch portion.

2. The antenna structure as claimed in claim 1, further comprising:

a nonconductive support element, wherein the ground metal element, the first metal element, and the second metal element are disposed on the nonconductive support element.

3. The antenna structure as claimed in claim 2, wherein the nonconductive support element is a plastic element, a PCB (Printed Circuit Board), or an FCB (Flexible Circuit Board).

4. The antenna structure as claimed in claim 1, wherein the first branch portion and the second branch portion of the slot are positioned at a side of the feeding point, and wherein the third branch portion and the fourth branch portion of the slot are positioned at an opposite side of the feeding point.

5. The antenna structure as claimed in claim 1, wherein the first branch portion of the slot has a first closed end, the second branch portion of the slot has a second closed end, the third branch portion of the slot has a third closed end, and the fourth branch portion of the slot has a fourth closed end.

6. The antenna structure as claimed in claim 1, wherein the antenna structure covers a first frequency band, a second frequency band, and a third frequency band, wherein the first frequency band is from 2400 MHz to 2500 MHz, wherein the second frequency band is from 5000 MHz to 6000 MHz, and wherein the third frequency band is from 6000 MHz to 7125 MHz.

7. The antenna structure as claimed in claim 6, wherein the slot further comprises a first connection portion, a second connection portion, a third connection portion, and a fourth connection portion, wherein the first connection portion is connected between the first branch portion and the second branch portion, wherein the second connection portion and the third connection portion are connected between the second branch portion and the third branch portion, and wherein the fourth connection portion is connected between the third branch portion and the fourth branch portion.

8. The antenna structure as claimed in claim 7, wherein the feeding point is positioned between the second connection portion and the third connection portion of the slot.

9. The antenna structure as claimed in claim 7, wherein a combination of the first connection portion, the second connection portion, the third connection portion, and the fourth connection portion of the slot substantially has a straight-line shape.

10. The antenna structure as claimed in claim 1, wherein each of the first branch portion, the second branch portion, the third branch portion, and the fourth branch portion of the slot substantially has a straight-line shape.

11. The antenna structure as claimed in claim 1, wherein the first branch portion, the second branch portion, the third branch portion, and the fourth branch portion of the slot are substantially parallel to each other.

12. The antenna structure as claimed in claim 1, wherein each of the first branch portion and the second branch portion of the slot has a relatively large width, and wherein each of the third branch portion and the fourth branch portion of the slot substantially has a relatively small width.

13. The antenna structure as claimed in claim 7, wherein a total length of the first branch portion, the first connection portion, and the second connection portion of the slot is from 0.5 to 1 wavelength of a central frequency of the first frequency band.

14. The antenna structure as claimed in claim 7, wherein a total length of the third branch portion and the third connection portion of the slot is from 0.5 to 1 wavelength of a central frequency of the second frequency band.

15. The antenna structure as claimed in claim 7, wherein a total length of the fourth branch portion, the fourth connection portion, and the third connection portion of the slot is from 0.5 to 1 wavelength of a central frequency of the third frequency band.

16. The antenna structure as claimed in claim 7, wherein each of the second connection portion and the third connection portion of the slot substantially has a variable-width L-shape.

17. The antenna structure as claimed in claim 1, further comprising:

a third metal element, coupled to the ground metal element, wherein the third metal element is disposed opposite to the first metal element.

18. The antenna structure as claimed in claim 1, wherein the second branch portion of the slot further comprises a right-angle bending terminal region.

19. The antenna structure as claimed in claim 1, wherein the third branch portion and the fourth branch portion of the slot are substantially perpendicular to each other.

20. An antenna structure, comprising:

a ground metal element, having a slot;

a first metal element, wherein a feeding point is positioned at the first metal element;

a second metal element, wherein the first metal element and the second metal element are coupled to the ground metal element, and wherein the first metal element and the second metal element extend into an interior of the slot;

wherein the slot comprises a first branch portion, a second branch portion, a third branch portion, and a fourth branch portion;

wherein the first metal element is disposed between the second branch portion and the third branch portion, and wherein the second metal element is disposed between the third branch portion and the fourth branch portion;

wherein the first metal element and the second metal element are substantially parallel to each other;

wherein the antenna structure further comprises:

a third metal element, coupled to the ground metal element, wherein the third metal element is disposed opposite to the first metal element; and a fourth metal element, coupled to the ground metal element, wherein the fourth metal element is disposed opposite to the second metal element.

* * * * *